United States Patent [19]

Fallos et al.

[11] 3,944,213

[45] Mar. 16, 1976

[54] HIGH SPEED DOCUMENT HANDLER

[75] Inventors: George Fallos, Easton; Wilbur J. Morrison, Nazareth, both of Pa.

[73] Assignee: Bell and Howell, Phillipsburg, N.J.

[22] Filed: Jan. 15, 1974

[21] Appl. No.: 433,487

[52] U.S. Cl. ..... 271/10; 271/121; 271/167; 271/275

[51] Int. Cl.[2].... B65H 3/06; B65H 3/46; B65H 5/02

[58] Field of Search ..... 271/121, 124, 34, 37, 167, 271/169, 10, 122, 123, 125, 126, 127, 109, 149, 150, 4

[56] References Cited

UNITED STATES PATENTS

| | | | |
|---|---|---|---|
| 928,637 | 7/1909 | Davidson | 271/116 |
| 1,038,406 | 9/1912 | McArdle et al. | 271/4 |
| 2,614,837 | 10/1952 | Cuthbert | 271/121 |
| 2,652,248 | 9/1953 | Johnson | 271/116 |
| 3,539,179 | 11/1970 | Bergman et al. | 271/126 X |

*Primary Examiner*—Evon C. Blunk
*Assistant Examiner*—Bruce H. Stoner, Jr.
*Attorney, Agent, or Firm*—Griffin, Branigan and Butler

[57] ABSTRACT

Disclosed is a document handler and feeder device for performing high speed separating and transporting of documents, such as business forms. The document handling unit is equipped with friction type feed rollers and a lipped contour plate over which documents must pass. The feed rollers contact and transport a foremost document from a gravity-feed document hopper. High speed tracking belts, are mounted over grooves or tracks, which extend along a track plate and through the lip of the contour plate. The feed rolls force the leading edge of the foremost document into the lip where the document engages the bottom side of the belts so that it is nipped between the belts and the contour plate causing the document to move into the tracking grooves.

The contour plate has a transition radius between its lip and the base of the document hopper upon which the foremost document rests. This radius is about ¼ the radius of the feed rolls which drive the foremost document up to the lip located above the hopper base a distance of about ⅔ the radius of the contour plate.

7 Claims, 10 Drawing Figures

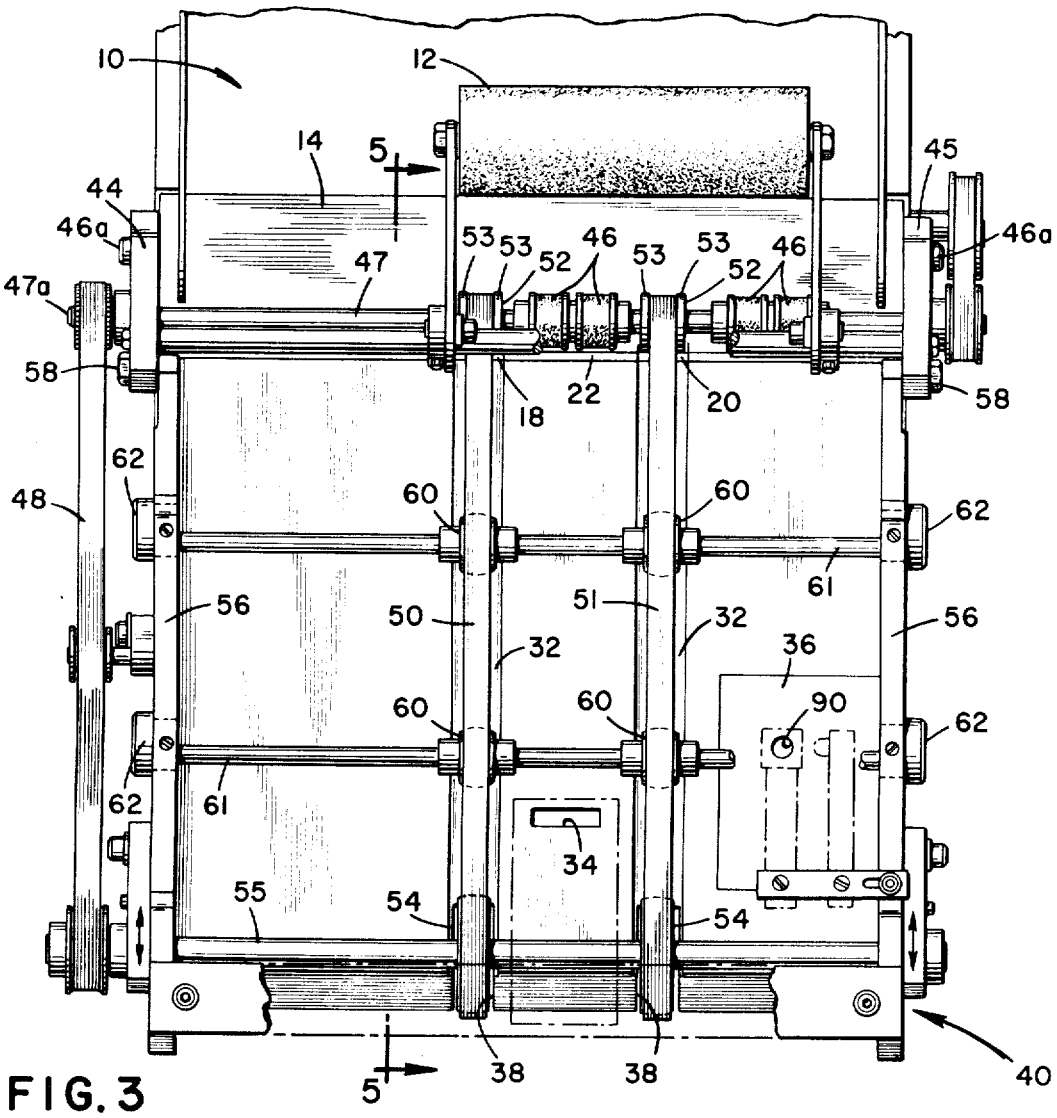
FIG. 3
FIG. 4
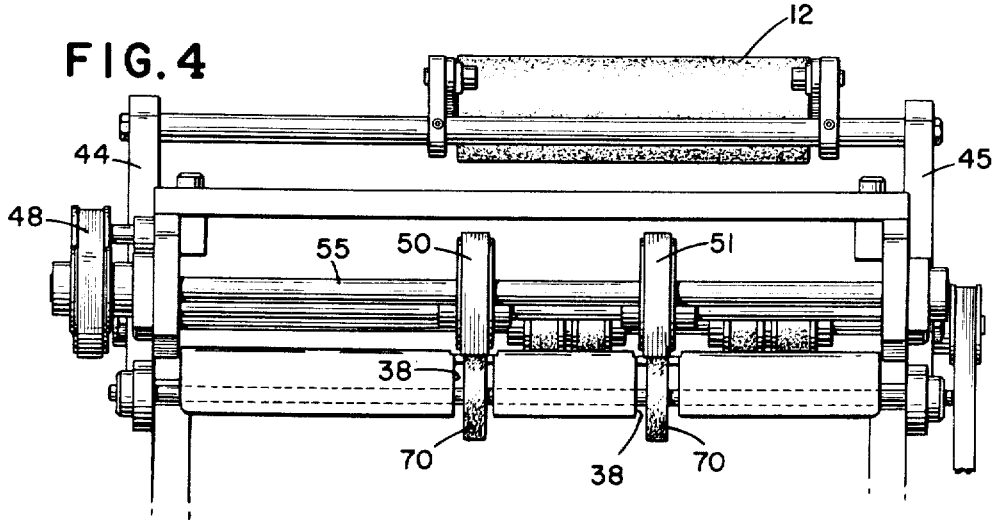

40
10
45
47
52
53
54
55
56
58
60
61
62
70
77
50
32
9
14
16
18
22
24
26
28
30
8a
8b

HIGH SPEED DOCUMENT HANDLER

BACKGROUND OF THE INVENTION

This invention is directed to a portion of an overall document feeder described and claimed in simultaneously filed commonly assigned application Ser. No. 433,498 by George Fallos entitled High Speed Document Feeder.

The invention relates to sheet feeding and delivering apparatus. In particular, it relates to a document handler and feeder device for accomplishing efficient single separation of documents from a hopper supply, and skewless high speed transport of such documents.

Current high speed document feeding apparatus exhibit tendencies to misfeed and to feed "doubles." Hence, for efficient handling of documents, a high speed document handler is needed which accomplishes consistent single separation of stacked documents and high speed transport of these documents with minimal misalignment. Whereupon, it is an object of this invention to provide a high speed document handler capable of separating a single document from a stack in a consistent manner without producing "missing" or "multiple feeding."

SUMMARY OF THE INVENTION

In accordance with principles of this invention, the objects as set forth are attained by providing an inclined document supply hopper equipped with feed rolls and a contour plate at its lower end. A roller or plate deflector is set to maintain the documents, such as cards or checks, in an upright, but backwardly sloping position. Mounted just before and above the surface of the contour plate are feed rollers which make initial transporting contact with the foremost document in a stack. A fixed "working" portion of the contour plate is a lip or ledge through which there are two grooves. These grooves mate with a second set of grooves which extend the entire length of a document-transport tracking plate.

Mounted adjacent the feed rollers is a set of tracking belts which are set into the grooves of the contour plate lip and, they too, run the length of the tracking plate. In this respect, the feed rollers deliver the document to the tracking belts which pull it over the contour plate's ledge and drive it down the tracking plate.

It is important to have a feeder which operates over a wide range of document thicknesses; and we have found that the above briefly described feed roll-contour plate structure performs admirably, particularly where the various elements have certain proportions. In this respect we have found that a transition radius between the hopper base at the bottom of the foremost document and the lip, should be about ¼ the radius of the feed rollers; and that a 0.10 inch transition radius is preferred. Similarly, we find that the lip should be located above the hopper base by a distance of about 1/6 the radius of the feed rollers.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention.

In the drawings:

FIG. 3 is a partial top view of a high speed document handler illustrating the feed rollers and tracking belts, as well as a hold back roller and a belt tension adjustment device;

FIG. 4 is a rear view of a high speed document handler, depicting the extension of the tracking belts into the tracking plate grooves and the driving connection between the tracking belts and ejection rollers;

DESCRIPTION OF A PREFERRED EMBODIMENT

Figure 1:
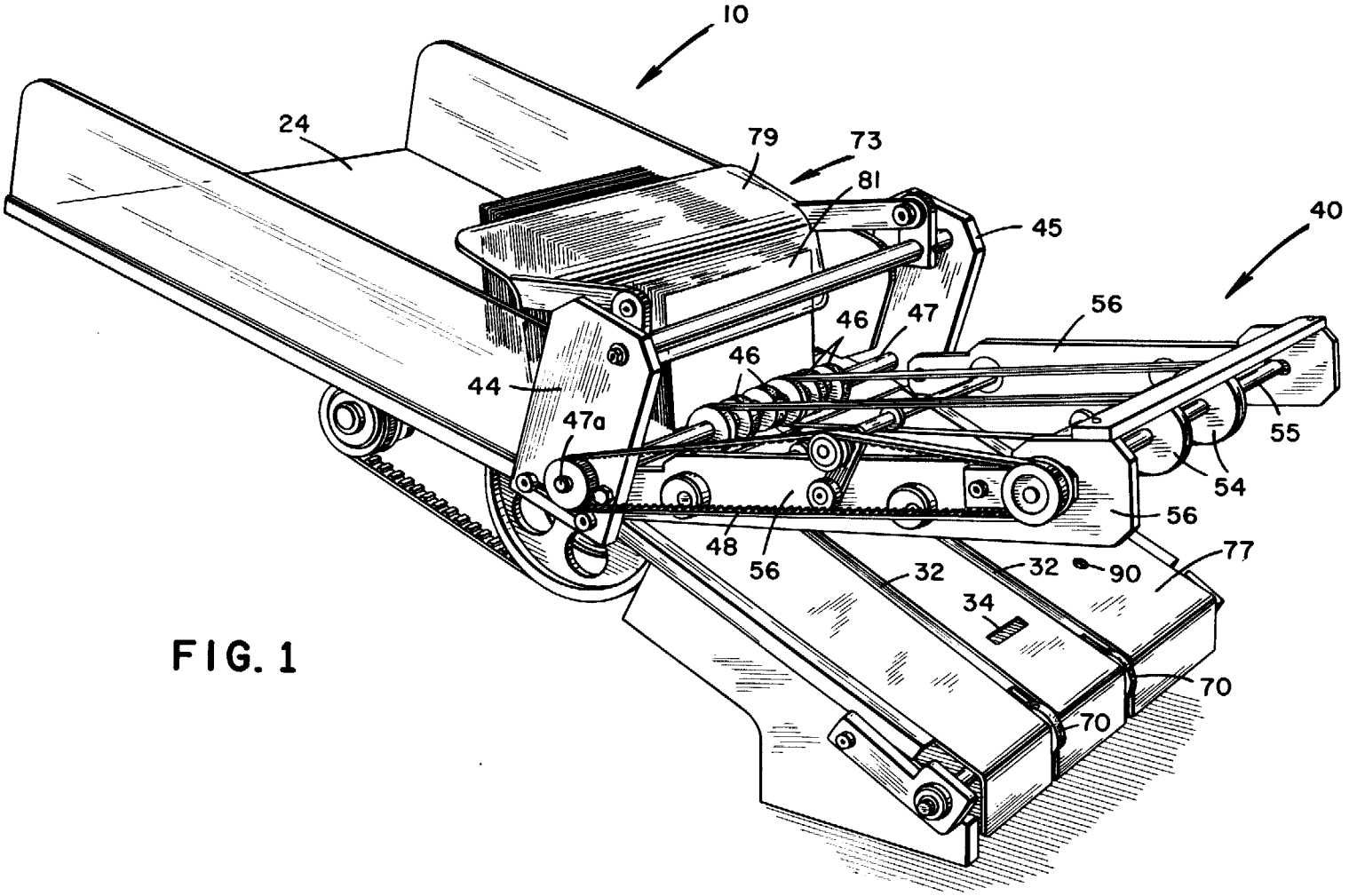
FIG. 1 is a side pictorial view of a high speed document handler including hold-back plate and bent hopper plate embodiments.

Referring to the elements as embodied in the drawings, numeral 10, in FIG. 1, generally represents a document stack hopper equipped with hold back plate 73 which serves to hold documents, such as cards, or checks, in a backwardly sloping position in the hopper to make an angle of recline with respect to a perpendicular to the bottom of the hopper. The front portion 81 of the hold back plate is set at an angle slightly less than the angle of recline of the held documents. That is, it is more nearly perpendicular to the bottom of the hopper. The top portion 79 of the plate 73, on the other hand, is set at an angle slightly greater than the hopper's angle of incline from horizontal. Thusly shaped, the hold back plate offers very low frictional resistance to documents during the feeding operation.

Figure 2:
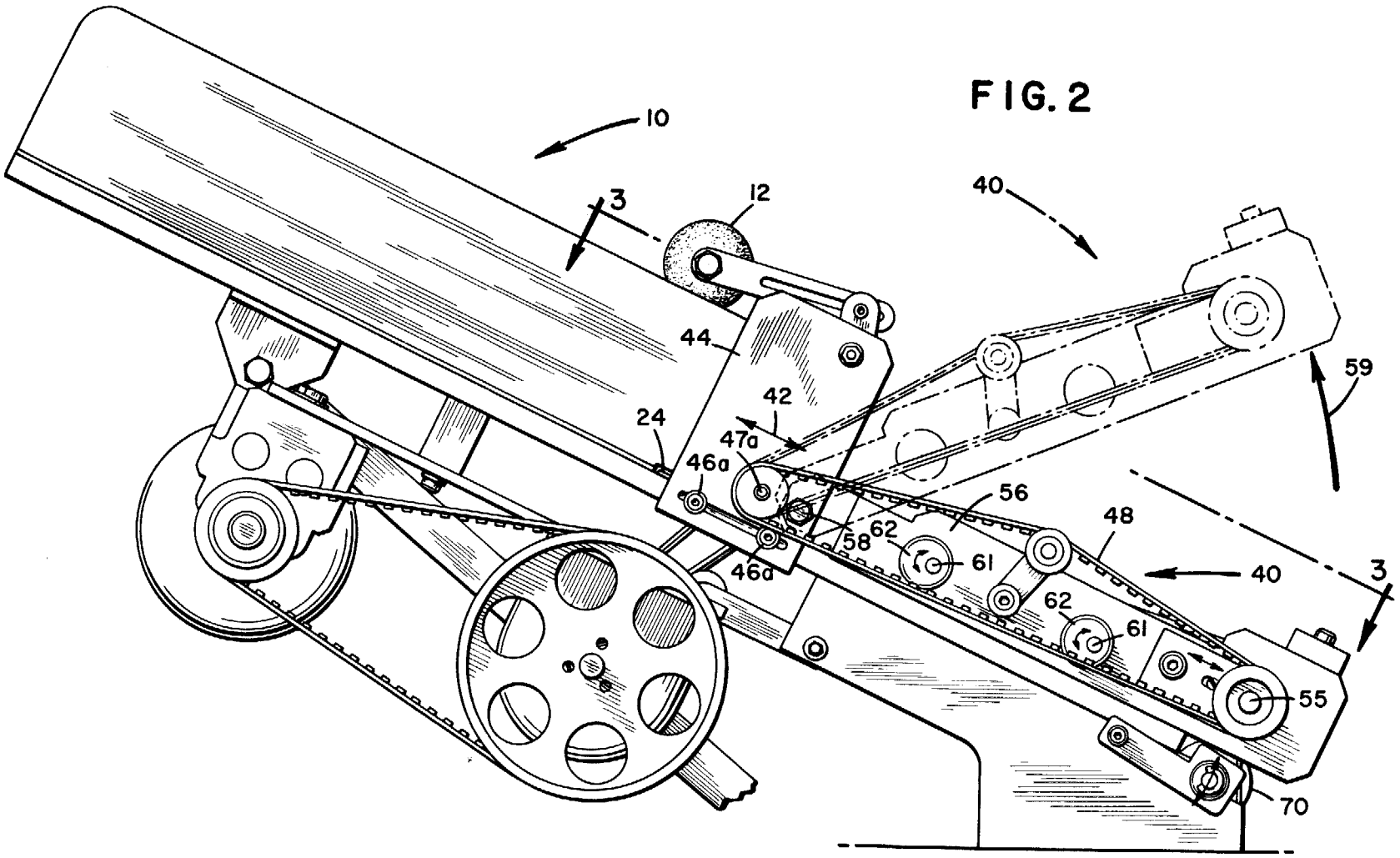
FIG. 2 is an overall side view of a high speed document handler, particularly illustrating a pivotable tracking belt assembly.

FIG. 1 also illustrates one embodiment of the angular relationship between a hopper plate 24 and tracking plate 77. The hopper plate here is set at about 12° from horizontal, as compared to about 25° from horizontal for the tracking plate. This arrangement tends to further reduce adverse frictional forces during the feeding operation. FIG. 2 shows an arrangement with hopper and tracking plates set at the same 25° angle.

Figures 5, 6, 7, 8A, 8B, 9:
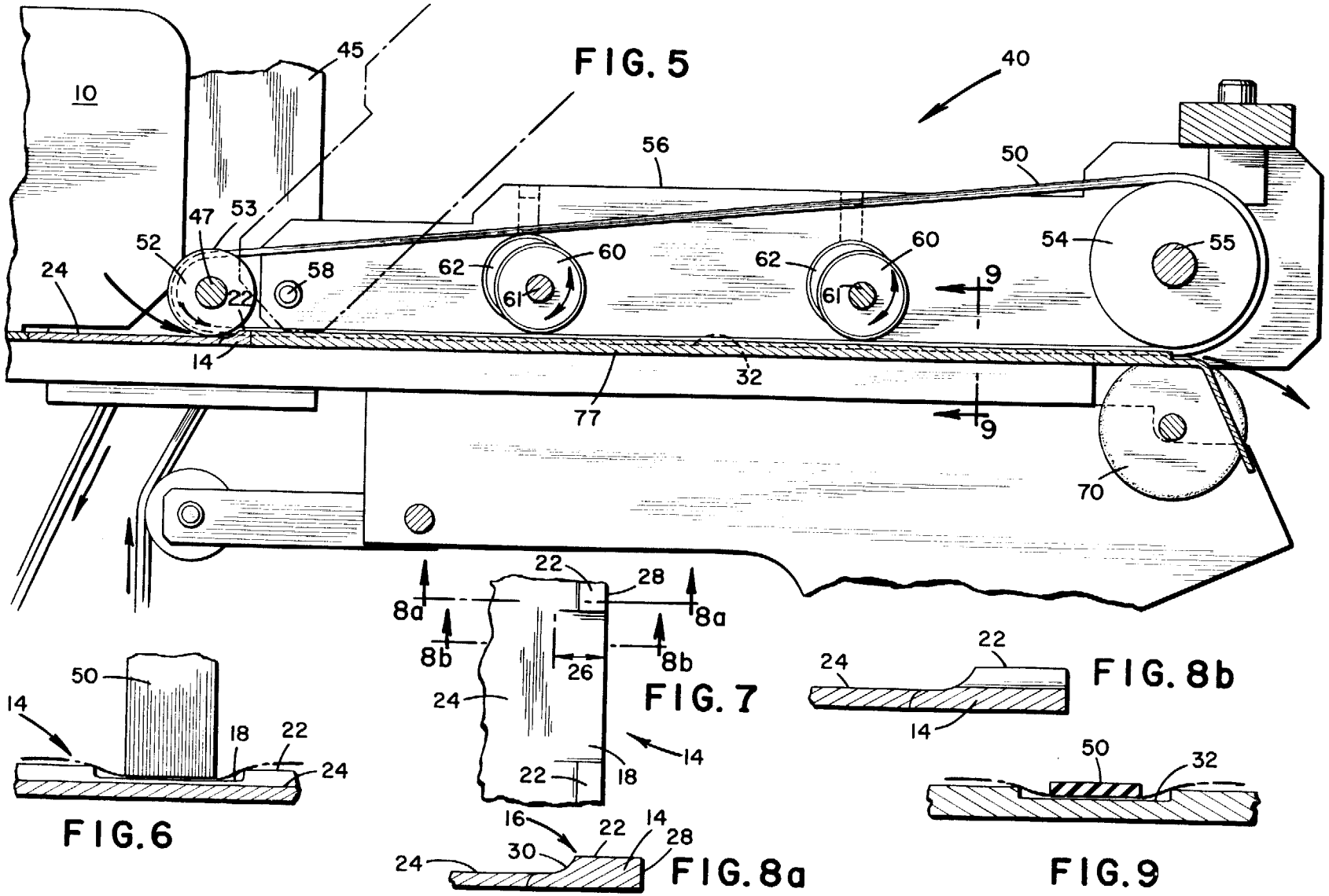
FIG. 5 is a partial side view of a high speed document handler showing the tracking belts extending into the grooves of the contour plate lip and tracking plate, and the adjusting means which determine belt depth.
FIG. 6 is a fragmentary view illustrating the relationship of the tracking belts and contour plate.
FIG. 7 is a fragmentary top view of the contour plate lip including one of its cutout grooves.
FIGS. 8*a* and 8*b* are enlarged side fragmentary views of the contour plate featuring its lip construction when viewed in section through non-grooved and grooved portions thereof respectively.
FIG. 9 is a fragmentary view illustrating the relationship between the tracking belts and the grooves of the tracking plate.

Set in the lowermost portion of the inclined hopper is a contour plate 14 which includes lip 16 (FIG. 8*a*). The surface of the contour plate is nitrided rather than chrome plated, as has been the customary surfacing on hopper-bottoms. Inasmuch as a chromed surface is more highly polished than a nitrided surface, it would be expected that a nitrided surface would introduce greater frictional engagement between a fed document and a hopper surface such as that of the contour plate. In this regard, the coefficient of friction for paper on a surface that is chrome plated is about 0.16, whereas the same surface when nitrided exhibits a coefficient of friction of about 0.25. Nevertheless, tests show that the nitrided surface on the contour plate of the instant invention allows for higher feed speeds than can be obtained with a more highly polished surface such as chrome. In this regard, the dynamic angle of repose, the angle, during operation, at which a document's component of gravity equals its frictional force with a surface, has been found to be about 9° for a chromed surface. This angle is approximately 14° for a similar structure with a nitrided surface. This seeming contradiction can possibly be explained by the reduction of static electricity by the nitrided surface. This static electricity builds up on the chromed surface and serves to restrict document movement. In addition, a nitrided surface exhibits more favorable wear characteristics than a chromed surface.

Grooves 18 and 20 (FIGS. 3 and 6) are cut into the lip 16 about two-thirds of the way from the top edge 22 of the lip to the upper surface of the hopper plate 24 which acts as a reference surface for various contour plate parameters having critical significance in connection with some of the invention's more detailed aspects. As illustrated best in FIGS. 7 and 8, these grooves extend the full width 26 of the lipped portion from its front surface 28 to a point on its rear radius 30 commensurate with the depth of the lip.

Fluted feed rollers 46 (FIG. 1) are driven by a feed roll shaft 47 which, in turn, is driven through a suitable clutch mechanism by a toothed drive-belt 48. These feed rollers are shaped somewhat like a series of common thread spools. That is, they have a cylindrical body portion with driving rims extending outwardly therefrom as shown in FIG. 1. It is these driving rims or fluted portions that make the initial contact with the foremost document in the hopper-held stack where the cards are jointly restrained by the hold back plate 79 and the lip 16. In this respect, the fluted rollers are mounted adjacent the radius 30 of the lip and serve to pull the foremost document downwardly and bend it across the lip. Through the use of fluted rollers rather than conventional solid rollers, the pull power of the feed rolls is enhanced. This result is accomplished because of the increased "angle of wrap" between the document and the feed rolls which results in an increase in pull power. In this respect, fluted rolls have been found to exhibit at least five times more pulling power than the solid rollers per inch width of the roller's peripheral surface.

Also mounted on shaft 47 are tracking belts 50 and 51 (see FIG. 3) which ride in idlers 52 that include rims 53 which extend outwardly beyond the surfaces of the belts and prevent the belts from making initial contact with the foremost document. These tracking belts extend down into grooves 18 and 20 in the contour plate lip and run the entire length of tracking plate 77 also having grooves 32 which are matingly aligned with the contour plate's grooves. The tracking belts are mounted on a belt assembly 40 that is removably fastened on top of the track plate, so that it is adjustable fore and aft in the direction of arrow 42 in FIG. 2. The belt assembly is comprised of pivot plates 44 and 45 (FIG. 3) that are affixed to the main frame by adjustable fasteners 46a.

As also shown in FIG. 3, the lower ends of the tracking belts ride on belt drive sheaves 54 which are mounted on belt drive shaft 55 that is also driven by belt 48. In this regard, the tracking belt drive sheaves are dimensioned so that the linear speed of the belts is about twice the peripheral speed of the feed rolls 53 mounted on shaft 47. The belt drive shaft 55 is mounted between subframe elements 56 which are pivotably mounted on frame elements 44 by pins 58 at the hopper end of the assembly. Thus, the entire subframe is pivotable upwardly as indicated by arrow 59 in FIG. 2. This easy swing-away motion of the tracking belt assembly allows access to the tracking plate area in order that possible jams can be removed. In addition, to facilitate feed roll replacement, the tracking belt assembly is pivoted about pins 58 instead of shaft 47. This eliminates bearing assemblies which would be necessary if the subframe were pivoted on the feed roll shaft. The absence of such bearing connections greatly facilitates removal and replacement of feed rolls.

As best illustrated in FIG. 5, belt-pressure rolls 60 are mounted on shafts 61 whose ends are, in turn, mounted in the subframe members 56 by means of eccentrics 62. These belt-pressure rollers are situated inside of the tracking belts 50, which, as noted, are located in direct alignment with and extend into tracking grooves 32 in the tracking plate as shown in FIG. 9. Rotation of the eccentrics 62 adjusts the pressure of the belt-pressure rolls 60 upon belts 50, and, accordingly, adjusts the tension of belts 50 and the depth to which these tracking belts are permitted to extend into the tracking grooves 32.

In the above regard, although the drawings illustrate two eccentric shafts 61, an alternate embodiment, not shown, uses only a single such eccentric shaft assembly and employs adjustable arms having one end attached to the shaft and a roller mounted on the other end thereof to substitute for the second set of belt pressure rolls 60 shown in FIG. 3. In this manner only a single eccentric adjustment is required.

In either of the belt-pressure embodiments just described, fine adjustment of the depth of the tracking belts permits ideal transport conditions to be set for a particular type of document being handled. In this regard, while some degree of forced distortion of a document into the grooves by the tracking belt permits high speed transport with a minimum of document skew, too much distortion of a document into the grooves would tend to create bending of the document, thus separating it from a flat position on the tracking plate and subjecting it to adverse aerodynamic forces which promote a skewing problem.

FIG. 4 depicts the exit end of the belt transport assembly. At this end, the driven tracking belts 50 and 51 engage elastomeric idler ejection rollers 70 which are set within ejection roll cutouts 38 in the tracking plate, coextensive with the grooves. These idler rollers are adjustable up and down and extend upwardly through the grooves in the tracking plate to put light pressure on the tracking belts 50 and 51.

The tracking plate 77 also is provided with cutouts such as 34 and 36, as illustrated in FIG. 3. Opening 36 accommodates a detector such as a photocell 90 for counting the number of documents passing thereover. It may be further stated the non-used, but exposed, portion of the track plate may be used at any point to accommodate a device (electronic or sensing) to serve the users' specific requirements for high speed feeding of documents.

In operation, documents, such as cards or checks, which are to be fed from a stack held by hopper 10 are initially contacted by the fluted feed rollers 46. The friction maintained between the feed roll and a foremost document is greater than the friction between the document being fed and a subsequent document. Consequently, the foremost document slides over the next document. However, in order to maintain a greater frictional force between it and a subsequent document, it is important that the fed document be gradually accelerated. If the feed rolls are rotated at too fast a speed, the coefficient of sliding friction between the feed rolls and the documents tends to drop to the point where the rollers merely slip rather than feed. Therefore, the feed rollers are driven at a relatively slow speed in comparison to the high speed transport accomplished by the tracking belts, as will be discussed below.

After the feed rollers initially bend the foremost document and pull it across radius 30 of the contour plate lip portion, the document is engaged by tracking belts 50 and 51 which are driven at about twice the speed of the feed rolls. Once the document has begun to slide over its next subsequent document its feed speed can be safely accelerated without creating "doubles." Prior to the time of engagement of the belts with the fed document (initially moved by the feed rollers) rims 52 and 53 on the tracking belt idlers prevent the document from contacting the belts. This allows the document to be accelerated from the slower speed of the feed rolls to the higher speed of the belts. As the document approaches the speed of the belts, the feed rolls exert somewhat of a drag force on the document which serves to slightly retard its acceleration at least until the document has moved a distance corresponding to its length. In this manner, the document's acceleration is relatively uniform throughout its initial motion from a stationary position at the document stack to the high speed of the belts themselves.

The radius 30 on lip 16 and the incline of the hopper 10 are such that it is a bit difficult for the document being fed to move upwardly to the top 22 of lip 16 in FIG. 8. However, the feed rolls need only move the document about 0.4 inches before the document is brought into engagement with the tracking belts. In this respect, the radius 30 of the leading edge of the lip is preferrably about ¼ the radius of the driving flute or rims of the feedrolls; and the height of the lip 16 above the reference surface 24 is preferrably about ⅜ the radius 30 (1/6 the radius of the driving flutes). Similarly, the depth of the grooves 18 and 20 preferably is about 75 percent of the lip height (⅛ of the radius of the driving flutes) depending on whether the documents to be fed are card stock, for example, or documents of much thinner composition. Similarly, the radius 30 can be varied between about half to twice that described above, also depending upon the weight of the documents handled. The designated sizes, however, have been found to be preferable, since they result in satisfactory performance over a wide range of document stocks. The width of the grooves cut through the lip of the contour plate is also significant. Preferably, the width should be no more than about 25 times its depth and no less than about 3 times its depth with the ratio therebetween preferably about 14; and a given belt is preferably about ⅜ the width of its grooves. This preferred range is dictated by the forces acting upon the document as it is being fed.

As noted, belts 50 andd 51 extend into grooves 18 and 20 cut through the lip. Hence, when the lead document is intercepted from the feed rollers during its initial feeding, the belts distort the document downwardly into the grooves. This distortion provides a greater than normal frictional force between the document and the belts, so that the next document does not also pass. Consequently, the lip grooves act as an additional deterrent to doubles. In other words, during the time the foremost document is being driven upwardly toward the top of the lip by the feed rolls, until it is acted on by the tracking belts and distorted into the grooves 18 and 20, the succeeding document is held back by radius 30 and does not "see" the distortion or additional frictional forces on the preceding document. Hence, there is little tendency for the succeeding document to follow its predecessor; whereupon, there is a greatly reduced tendency for the instant structure to feed "doubles."

As noted above, the feed rolls are adjustable fore and aft, so as to adjust the initial point at which the documents are brought into engagement with the lip; and also the point at which the document are brought into engagement with the tracking belts. The vertical clearance between the feed rollers and the plate surface 24 is fixed to accommodate the average thickness of the documents being fed. This differs significantly from conventional devices, wherein feed rolls are positioned by vertical motion to merely vary the pressure on the documents being fed.

After a document has passed fully over lip 16 and is urged into the tracking grooves 32 by tracking belts 50 and 51, it is now under full control of the belts. The width of the tracking plate grooves is about the same as the width of the contour plates grooves. However, the depth of the tracking plate grooves is only about ⅜ the depth of the contour plates grooves cut into the lip. The rationale for this relationship is that the document moves along the tracking plate at a high speed, such that aerodynamic forces on the document are greatly increased from those occuring at the contour plate lip. Consequently, the less the belts tend to distort the document into the tracking plate grooves, the better the control and ability to read the surface identification with electronic devices. Consequently, by decreasing the depth of the tracking plate grooves over those of the contour plate lip grooves the documents can be fed faster without skewing or jamming tendencies when ejected and stacked. It is important that a given document be sufficiently accelerated from the speed of its succeeding document, so that there is substantial separation between documents. This is to assure further separation between documents that may be of a larger size than normally used.

The reason for obtaining such separation is in order to count or read the documents individually.

As a document continues along the tracking plate it is pinched between ejection rollers 70 and the tracking belt at the belt sheaves 64. As previously noted, the pressure and location of the idler rolls 70 is substantially vertically adjustable by pivoting about an arm as indicated. Hence, again, selective pressure adjustment is used in conjunction with variation of the ejection assembly fore and aft to vary the trajectory angle of documents as they exit from the tracking plate.

While the invention has been particularly shown and described with reference to preferred embodiments thereof, it will be understood by those skilled in the art that various alterations in form and detail may be made therein without departing from the spirit and scope of the invention. For example, the multiple variations as suggested may be incorporated so as to accommodate particular types of documents; and the dual belt assembly could be altered for a multiple or perhaps even a single belt arrangement.

The embodiments of the invention in which an exclusive property or privilege is claimed is defined as follows:

1. A document feeder comprising:

a document stack hopper having a base surface for supporting a stack of documents in said hopper;

a lipped contour plate located adjacent said base surface for forming a lip surface adjacent to said base surface, rising from said base surface in a substantially abrupt manner but including a fillet portion for forming a smooth transition from said base surface; and a feed roll located above said base surface adjacent said lip surface and adapted to engage the foremost document of said stack supported by the base surface of said hopper and to drive said foremost document toward said lip surface;

wherein said filled portion or concave junction of said lip surface with said base surface has a transition radius which is about one quarter of the radius of said feed roll.

2. The document feeder of claim 1 wherein said transition radius is about 0.10 inch.

3. The document feeder of claim 1 wherein the highest point of said lip surface is about 1/6 of the feed roll radius above said base surface of said hopper.

4. The document feeder of claim 1 including a tracking belt means for transporting a document away from said contour plate at a speed greater than the speed at which said feed roll removes said foremost document from said document stack, but wherein said feed roll continues to engage said foremost document during said foremost document's initial contact with said tracking belt means.

5. The document feeder of claim 4 wherein said transition radius is about one quarter of the radius of said feed roll.

6. The document feeder of claim 4 wherein said transition radius is about 0.10 inch.

7. The document feeder of claim 4 wherein the highest point of said lip surface is about 1/6 of the feed roll radius above said base surface of said hopper.

* * * * *